US008272545B1

(12) United States Patent
Saffran

(10) Patent No.: US 8,272,545 B1
(45) Date of Patent: Sep. 25, 2012

(54) BOTTLE CARRIER

(76) Inventor: Lawrence D. Saffran, Bethany, CT (US)

( * ) Notice: Subject to any disclaimer, the term of this patent is extended or adjusted under 35 U.S.C. 154(b) by 352 days.

(21) Appl. No.: 11/751,253

(22) Filed: May 21, 2007

Related U.S. Application Data

(63) Continuation-in-part of application No. 10/948,371, filed on Sep. 22, 2004, now abandoned.

(60) Provisional application No. 60/747,810, filed on May 21, 2006.

(51) Int. Cl.
*A45F 3/16* (2006.01)
*A45F 5/00* (2006.01)

(52) U.S. Cl. ..... 224/148.4; 224/148.6; 224/251

(58) Field of Classification Search ..... 224/148.1, 224/148.4, 148.5, 148.6, 148.7, 414, 251; D3/229
See application file for complete search history.

(56) References Cited

U.S. PATENT DOCUMENTS

| | | | | |
|---|---|---|---|---|
| 2,317,820 | A | 4/1943 | Smith | |
| 3,192,555 | A * | 7/1965 | Nyden | 401/139 |
| 4,770,305 | A * | 9/1988 | Su | 215/250 |
| 4,815,999 | A * | 3/1989 | Ayon et al. | 446/73 |
| 5,301,857 | A | 4/1994 | Green | |
| D347,734 | S | 6/1994 | Patterson et al. | |
| 5,573,152 | A | 11/1996 | Arnold | |
| 5,593,074 | A | 1/1997 | Matthews | |
| 5,613,657 | A | 3/1997 | Olaiz | |
| 5,636,740 | A * | 6/1997 | Finkiewicz et al. | 206/457 |
| 5,695,232 | A | 12/1997 | Tipp | |
| 5,944,238 | A * | 8/1999 | Stark | 224/148.4 |
| 5,954,247 | A | 9/1999 | Savine et al. | |
| D419,880 | S * | 2/2000 | Adams | D9/451 |
| 6,019,335 | A | 2/2000 | Sehati | |
| 6,029,870 | A | 2/2000 | Giacona, III | |
| 6,131,779 | A | 10/2000 | Gendala | |
| 6,131,780 | A | 10/2000 | Becker | |
| 6,533,148 | B1 | 3/2003 | Dahl | |
| 6,550,271 | B2 | 4/2003 | Silbert | |
| D474,938 | S * | 5/2003 | Malik | D7/392.1 |
| 6,626,333 | B2 | 9/2003 | Levesque et al. | |
| 6,695,371 | B1 | 2/2004 | Simkins | |
| D491,465 | S | 6/2004 | Kelleghan | |
| 6,837,472 | B1 | 1/2005 | Beutz | |
| 2002/0084240 | A1 * | 7/2002 | Yu-Hsien | 215/258 |
| 2003/0111496 | A1 | 6/2003 | Abbott | |
| 2005/0035080 | A1 * | 2/2005 | Romero | 215/228 |

* cited by examiner

*Primary Examiner* — Justin Larson
(74) *Attorney, Agent, or Firm* — Bachman & LaPointe, P.C.

(57) ABSTRACT

A bottle carrier has a resilient ring dimensioned to encircle a neck of the bottle in an installed condition. A brim is unitarily formed with and depends from the resilient ring and is dimensioned to fall in facing or contacting relation to a shoulder of the bottle.

22 Claims, 3 Drawing Sheets

BOTTLE CARRIER

CROSS-REFERENCE TO RELATED APPLICATION

This application claims benefit of Ser. No. 60/747,810 filed on May 21, 2006 and is a continuation in part of Ser. No. 10/948,371, filed Sep. 22, 2004, now abandoned. The disclosures of applications 60/747,810 and 10/948,371 are incorporated by reference in their entireties herein as if set forth at length.

BACKGROUND OF THE INVENTION

The invention relates to beverage containers. More particularly, The invention relates to carriers for single beverage bottles.

There are a wide variety of prior art bottle carriers. Examples of one class of these are shown in: U.S. Pat. Nos. 5,954,247, 6,029,870, 6,131,780, 6,533,148, 6,550,271, 6,626,333, Des. 347,734, and Des. 491,465; and US published patent application 2003/0111496. Advantageously, a carrier provides hands-free transport of a single bottle, allowing the user to periodically drink from the bottle.

SUMMARY OF THE INVENTION

One aspect of the invention a carrier for a beverage bottle. The carrier has a resilient ring dimensioned to encircle a neck of the bottle in an installed condition. A brim is unitarily formed with and depends from the resilient ring and is dimensioned to fall in facing or contacting relation to a shoulder of the bottle in the installed condition. The user may carry the bottle via a carrying loop such as a lanyard.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
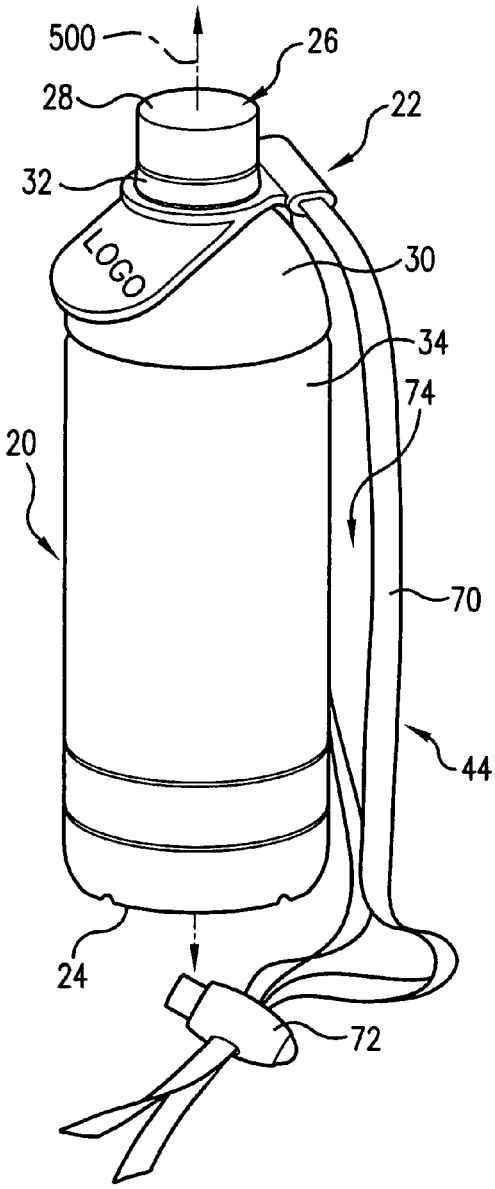
FIG. 1 is a view of a carrier on a bottle.
Figure 2:
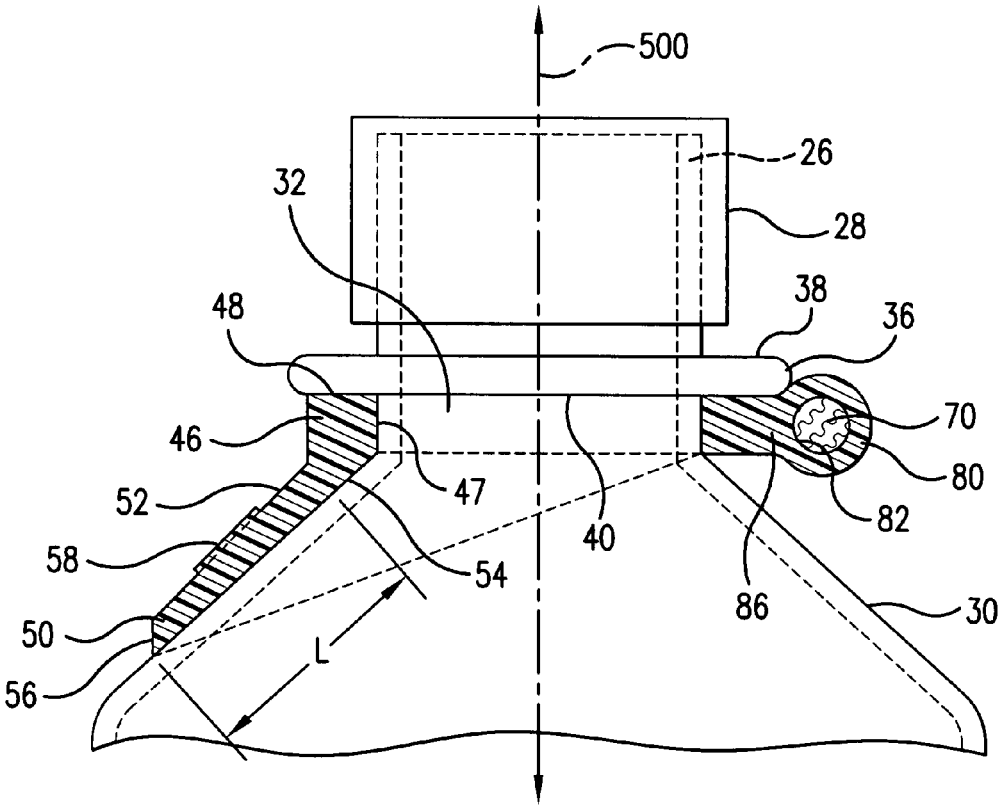
FIG. 2 is a partial medial sectional view of a bottle and carrier.

FIG. 1 shows a bottle 20 assembled with a carrying apparatus 22. The exemplary bottle has a central longitudinal axis 500 and extends from a bottom/base 24 to a threaded mouth 26 which bears an internally threaded cap 28. The cap may be a simple closure or a cap/valve assembly. The bottle has a shoulder 30 separating a neck 32 from a body 34. Some bottles may include a neck flange 36 (FIG. 2) circumscribing the neck and having an upper surface 38 and a lower (underside) surface 40.

Figure 3:
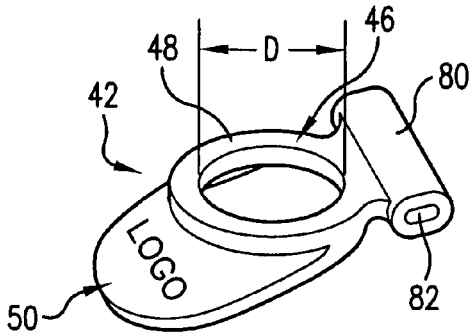
FIG. 3 is a view of a molded component of a carrier.

The apparatus 22 comprises the combination of a unitarily-molded bottle—engaging member 42 (FIG. 3) and a lanyard assembly 44 (FIG. 1). The member 42 may be molded from a resilient material such as a thermoplastic elastomer (TPE), a rubber, or polyvinyl chloride (PVC). The member 42 has a ring portion 46 (FIG. 2) encircling the neck and having an interior surface engaging the neck exterior surface. The ring 46 has an interior surface 47 for engaging the neck 32 and an upper rim surface 48 for engaging the flange underside to resist passage of the flange 36 downward through the ring. The engagement may comprise a full circumferential contact. A brim 50 depends from the ring. An exemplary brim is not symmetric around the axis 500 (e.g., so as to resemble the brim of a baseball or similar cap). The exemplary brim has a root portion at the ring extending less than a full 360° (e.g., somewhat over 180°) about the axis 500. The brim extends generally downward and forward.

The exemplary brim 50 has a convex outer surface 52 (relative to the axis 500) and a concave inner surface 54 joined by a rim 56. The outer surface 52 may have molded logo 58 (e.g., protruding and/or recessed and/or painted or integrally colored) such as wording/lettering and/or graphics and/or other visual indicia. The inner surface 54 may contact or closely face an adjacent tapering portion of the shoulder 30. An arcuate distal rim portion joins the outer surface 52 and inner surface 54. The brim further has a pair of proximal side portions which extend to the rim and simulate the protruding brim as the bill of the baseball-style cap.

Figure 4:
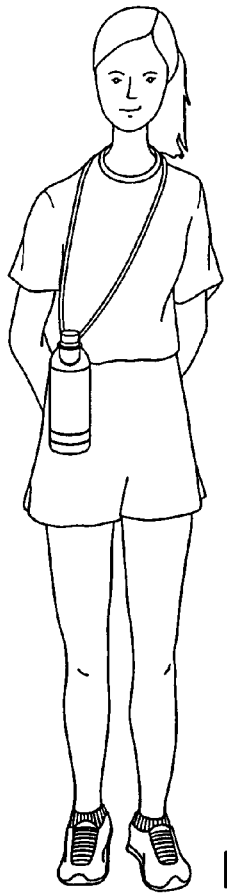
FIG. 4 is a view of a user holding a bottle via a carrier

The exemplary lanyard assembly 44 includes a flat woven cloth strap 70 and a slider 72 though which the strap passes. Such a flat strap can readily accommodate logos (e.g. a logo repeated along its length) for advertising/promotional purposes or ornamentation. The slider permits user adjustment of the size of a strap loop 74 to comfortably and conveniently accommodate the user's neck and/or shoulder for carrying and access (FIG. 4). Cordage and non-woven (e.g., leather) straps are alternatives. To mount the member 42 to the lanyard assembly 44, the exemplary member 42 includes a tubular portion 80 (FIG. 2) having an interior surface 82 defining a passageway through which the strap passes. The exemplary tubular portion 80 is formed at the distal end of a short web 86 extending aft from the ring portion 46 and is oriented tangentially relative to the ring (i.e., the passageway length is normal to and offset from the axis 500 outboard of the ring).

The apparatus may be sized to accommodate a corresponding group of bottles. Exemplary relaxed ring IDs D (FIG. 3) (perimeter/$2\pi$ if noncircular when relaxed) are 0.6-2.0 inches, more narrowly 0.8-1.5 inches. For positive retention, the ring may be slightly strained (e.g., circumferentially stretched) in the installed condition, especially for flangeless bottles, to frictionally bear against the neck along essentially the full circumference thereof. The ring should have sufficient resilience to permit many installation/removal cycles (e.g., over one hundred). Exemplary loop circumferential lengths are 2-7 feet, more narrowly 3-6 feet, to accommodate a user's shoulder and/or neck area and may be adjustable. Exemplary brim lengths L (FIG. 2) are 0.5-1.5 inches, more narrowly 0.6-1.0 inch at the forward end, tapering toward the rear of the ring. Such a brim size may accommodate a sufficiently large logo to serve advertising/promotional purposes (e.g., for the apparatus or an unrelated good/service). The brim may also be grasped by the user to install/remove the apparatus.

Figure 5:
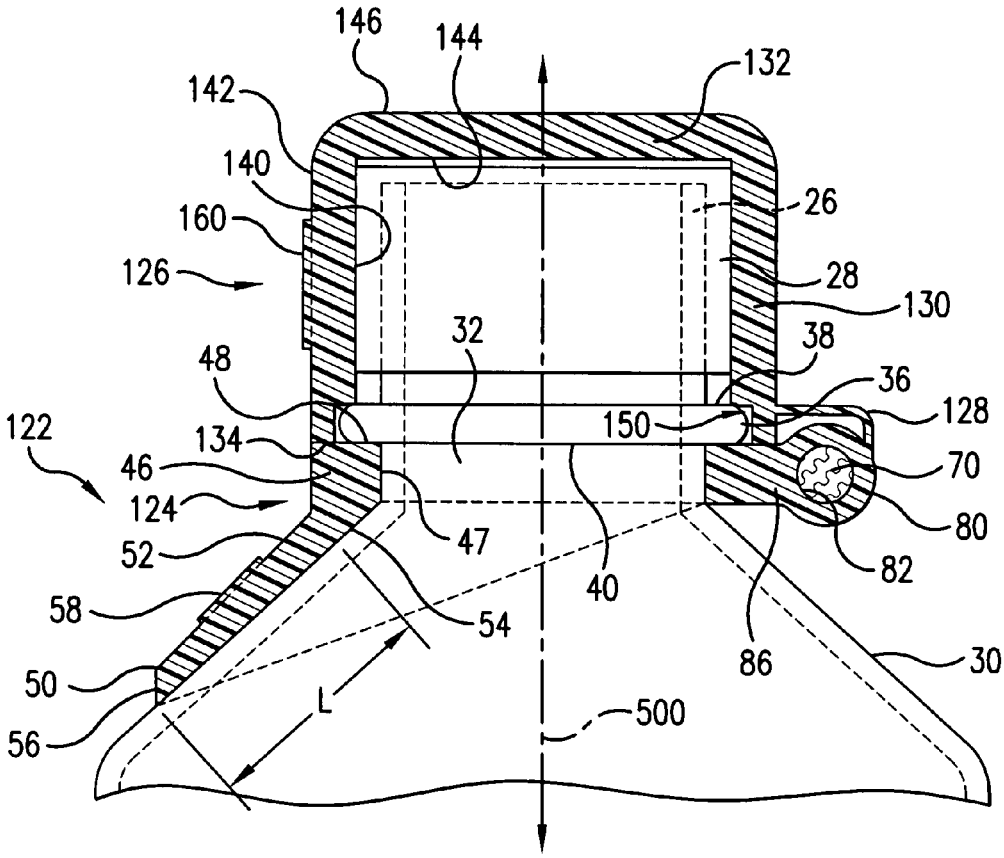
FIG. 5 is a partial medial sectional view of a bottle and alternate carrier.

FIG. 5 shows an alternate carrier 122 wherein the molded bottle-engaging member 124 further includes a cover 126 and a living hinge 128. Features common to the carrier 22 and its bottle-engaging member 42 are referenced with like numerals. The exemplary cover 126 includes a sidewall 130 and a top or upper web 132 at the upper end of the sidewall 130. The sidewall 130 extends to a lower rim 134. The sidewall has an inner/interior/inboard surface 140 and an outer/exterior/outboard surface 142. Similarly, the web 132 has an inner/interior/inboard/lower surface or underside 144 and an outer/exterior/top surface 146. In the exemplary installed condition, the surface 140 may closely face or compressively engage the periphery of the cap. The cover is formed with a rebate 150 extending from the sidewall rim 134 and inboard surface 140 and accommodating the bottle flange 36.

The rim 134 may be positioned to contact or closely face the ring upper rim surface 48 outboard of the bottle flange. In the exemplary carrier, the rim 134 is contacting but physically separate from the upper rim surface 48 of the ring along a majority of the circumferential span (e.g., along an entirety thereof). The bottle-engaging member 124 may be initially molded with this separation between rim and ring. Alternatively, the initial molding may leave them partially connected with connections that may be severed upon opening of the cover. The exemplary hinge 128 loops from the sidewall to the tubular portion to provide a relatively large degree of accommodation between open and closed conditions. Retention in the closed condition may be by elasticity and/or a detent action (e.g., a cover inward projection interfitting in a cap feature or between the cap lower rim and the flange).

FIG. 5 shows a condition wherein the ring is in an installed condition and the cover is in an installed/closed condition covering the cap. The combination of cover, ring, and brim may further create the appearance of a baseball-style cap with the cover adding the baseball cap's dome to the brim provided by the brim 50. Thus, the cover (especially the forward portion of the sidewall), may similarly bear a logo 160 in addition to or in lieu of the brim logo 58. The cover logo may simulate a team logo of a baseball or other team to simulate the cap of such team.

The cover may be shifted to an open condition exposing the cap. The opening may include circumferential stretching of the cover sidewall 130 to disengage from the bottle cap. The hinge may function to retain the cover to prevent its loss.

Alternative covers could lack the rebate. For example, with a relatively larger bottle flange, the cover lower rim might be fully occluded by the flange from exposure to the ring (e.g., with the ring and lower rim sandwiching the flange). Other variations might feature a flange-accommodating rebate in the ring upper rim surface. Other variations might be shaped to accommodate a cap/valve assembly.

One or more embodiments of the present invention have been described. Nevertheless, it will be understood that various modifications may be made without departing from the spirit and scope of the invention. For example, details of any particular implementation may be influences by details of the particular bottles with which the carrier is to be used. Accordingly, other embodiments are within the scope of the following claims.

What is claimed is:

1. An apparatus for carrying a bottle, the bottle having a neck and the apparatus comprising:

a resilient ring defining an opening about a central axis dimensioned to encircle a neck of the bottle in an installed condition, wherein the ring allows exposure of a cap of the bottle for opening of the cap when in the installed condition;

a brim, unitarily formed with the resilient ring so as to extend outwardly and at a downward angle relative to the ring and dimensioned to fall in facing or contacting relation to a shoulder of the bottle in the installed condition, the brim being asymmetric about the central axis;

a carrying loop; and means unitarily formed with the resilient ring and circumferentially offset from the brim for securing the carrying loop to the resilient ring.

2. The apparatus of claim 1 wherein:

the brim provides means for simulating a brim of a baseball-style cap; and the carrying loop comprises cordage and a slider engaging the cordage to adjust a size of the carrying loop.

3. The apparatus of claim 1 wherein:

the resilient ring is formed of material selected from the group consisting of:

thermoplastic elastomers; rubbers; and PVC.

4. The apparatus of claim 1 further comprising:

a cover, unitarily formed with the ring, and a living hinge, unitarily formed with the cover and ring and coupling the cover to the ring.

5. A combination comprising:

the apparatus of claim 1; and the bottle and wherein:

the resilient ring is captured beneath a flange of the bottle in said installed condition carrying the bottle, but has sufficient elasticity to be stretched over the flange to be removed and reinstalled on a second like bottle.

6. The combination of claim 5 wherein:

the ring frictionally bears against the neck along essentially a full circumference of the neck; and the ring bears against the flange along essentially a full circumference of the flange.

7. The combination of claim 5 wherein:

the resilient ring is in circumferential tension in the installed condition.

8. The combination of claim 5 wherein:

the brim has:

a circumferentially concave lower/inboard surface along a shoulder of the body;

a circumferentially convex upper/outboard surface; and an arcuate distal rim portion joining the lower/inboard surface and the upper/outboard surface.

9. The combination of claim 5 wherein:

the brim has a pair of divergent proximal side portions so that the brim forms a protruding bill.

10. The combination of claim 5 wherein:

the apparatus further comprises a dome, unitarily formed with the ring, the brim, and the means for securing, said dome covering a cap of the bottle.

11. An apparatus for carrying a bottle comprising the unitarily molded combination of:

a resilient ring for encircling a neck of the bottle in an installed condition, and defining an opening about a central axis, wherein the ring allows exposure of a cap of the bottle for opening of the cap when in the installed condition;

a brim, extending outwardly and at a downward angle from the resilient ring and asymmetric about the central axis; and a tubular portion offset from the brim for receiving a carrying loop.

12. The apparatus of claim 11 wherein the brim has a root portion at the ring extending over 180° but less than 360° about said central axis of the ring.

13. The apparatus of claim 11 wherein said tubular portion is oriented essentially tangent to the resilient ring and the brim depends from the resilient ring in a relaxed condition, having a convex upper surface and a concave lower surface.

14. The apparatus of claim 11 wherein said combination is molded from material selected from the group consisting of thermoplastic elastomers.

15. The apparatus of claim 11 wherein said brim has an outer surface bearing molded indicia.

16. A method for using the apparatus of claim 11 comprising:

stretching the ring into engagement with the neck of a bottle to encircle the neck, the stretching comprising a circumferential expansion of the ring effective to pass over the flange and followed by a partial relaxation; and carrying the bottle by a carrying loop received by the tubular portion, during the carrying, the ring fully circumferentially encircling the neck below the flange.

17. The apparatus of claim 11 wherein:

the tubular portion is at a rear of the ring and open transverse to said central axis of the ring; and the brim protrudes downward and forward asymmetrically relative to said central axis and tapers toward the rear of the ring.

18. The apparatus of claim 11 further comprising.

a cover, unitarily formed with the ring, and a living hinge, unitarily formed with the cover and ring and coupling the cover to the ring.

19. The apparatus of claim 18 wherein:

the living hinge connects the cover to the tubular portion.

20. An apparatus for carrying a bottle comprising:

the unitarily molded combination of:

means for engaging the bottle below a neck flange of the bottle in an installed condition, wherein the means for engaging the bottle below the neck flange allows exposure of a cap of the bottle for opening of the cap when in an installed condition; and means for simulating a brim of a baseball-style cap depending from the ring non-symmetrically around a central axis of the ring; and a carrying loop engaged to the unitarily molded combination and offset from the means for simulating a brim of a baseball-style cap.

21. The apparatus of claim 20 wherein:

the unitarily molded combination further comprises means for simulating a dome of said cap; and the carrying loop is adjustable.

22. The apparatus of claim 20 wherein:

the means for engaging the bottle below the neck flange comprises a ring;

the unitarily molded combination includes means for engaging the carrier loop located diametrically opposite the protrusion of the means for simulating.

* * * * *